United States Patent [19]

Nordström et al.

[11] Patent Number: 4,863,342

[45] Date of Patent: Sep. 5, 1989

[54] GAS TURBINE WITH LINK ATTACHMENT OF A SEALING RING IN A GUIDE VANE RING

[75] Inventors: Karl-Johan Nordström; Ragnar Torstenfelt, both of Finspong, Sweden

[73] Assignee: ABB Stal AB, Sweden

[21] Appl. No.: 271,257

[22] Filed: Nov. 15, 1988

[30] Foreign Application Priority Data

Nov. 19, 1987 [SE] Sweden ..... 87045530

[51] Int. Cl.[4] ..... F04D 29/24; F04D 29/08

[52] U.S. Cl. ..... 415/134; 415/139; 415/209.4; 415/189; 415/173.7

[58] Field of Search ..... 415/134, 136, 139, 137, 415/217, 189, 191

[56] References Cited

U.S. PATENT DOCUMENTS

| | | | |
|---|---|---|---|
| 3,302,926 | 2/1967 | Bobo | 415/136 |
| 3,529,904 | 9/1970 | Scalzo et al. | 415/136 |
| 4,384,822 | 5/1983 | Schweikl et al. | 415/137 |

FOREIGN PATENT DOCUMENTS

| | | | |
|---|---|---|---|
| 58272 | 2/1981 | European Pat. Off. | 415/134 |
| 346586 | 7/1972 | Sweden . | |
| 420632 | 10/1981 | Sweden . | |
| 2034415 | 6/1980 | United Kingdom | 415/139 |

*Primary Examiner*—Robert E. Garrett
*Assistant Examiner*—Michael V. Readey
*Attorney, Agent, or Firm*—Pollock, Vande Sande & Priddy

[57] ABSTRACT

A gas turbine with at least one fixed guide vane ring (1) with a sealing ring (3) cooperating with a sealing member on the turbine rotor (7). The sealing ring (3) is connected to the guide vane ring (1) through a number of links (19) which are suitably oriented in a substantially tangential direction. The attachment of the sealing ring (3) by means of the links (19) means a perfect centering of the sealing ring (3) relative to the rotor (7) when the guide vane ring (1) expands relative to the sealing ring (3).

4 Claims, 3 Drawing Sheets

C-C

A-A

B-B

GAS TURBINE WITH LINK ATTACHMENT OF A SEALING RING IN A GUIDE VANE RING

TECHNICAL FIELD

The invention relates to a gas turbine with sealing rings which are movably attached in the fixed guide vane rings of the turbine and cooperate with sealing members on the turbine rotor.

BACKGROUND ART

In gas turbines, the rotor, the inner part of rotor discs, sealing members on the rotor and sealing rings, cooperating with the sealing members of the rotor and connected to the fixed guide vane rings, are cooled. Cooling air is supplied through the rotor. The guide vane rings attain a considerably higher temperature than the sealing rings. To prevent great thermal stresses due to different expansion, the sealing rings are movably connected to the guide vane rings. The sealing rings can be connected to a guide vane with radial pins in the guide vanes, which pins project into openings in the sealing rings. The friction between these pins and the sealaing rings may lead to the geometrical axis of the sealing rings being displaced relative to the geometrical axis of the rotor. The resultant eccentricity entails damage to the sealing members on the ring or the rotor, as well as axial leakage resulting in hot combustion gases passing the guide vane ring through gaps formed. A harmful heating of the rotor is obtained.

DISCLOSURE OF THE INVENTION

According to the invention, a sealing ring in a guide vane ring is connected to the guide vane ring by means of a number of links, at least three, one end of whichb eing articulately attached to the guide vane inner shroud and the other end to the sealing ring. The links have an orientation deviating from a radial direction. The angle between the links and radial planes should be greater than 45°. They are suitably oriented tangentially or almost tangentially. In the guide vane ring, a number of guide vanes are connected to each other in groups at the inner shroud of the vanes. The sealing ring is connected through the links to at least three of these guide vane groups, suitably to all of them. With this attachment of the sealing ring in a guide vane ring, an almost frictionless connection of sealing ring and guide vane ring and a very good centering of the sealing ring in relation to the rotor are obtained. Alternatively, the sealing ring and the guide vane ring may be connected, in the tangential plane, with flexible rods, which are rigidly connected, at their ends, to the sealing ring and the guide vane ring, respectively.

DESCRIPTION OF THE PREFERRED EMBODIMENT

Figure 1:
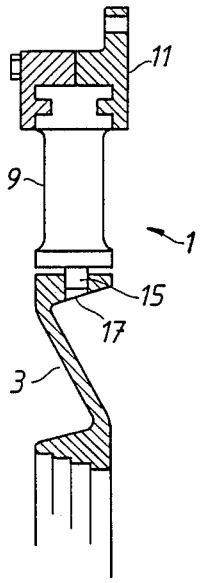
FIGS. 1 and 2 schematically show a conventional method of attaching a ring 3, sealing against the rotor, in a guide vane inner shroud, FIG. 1 being an axial section and FIG. 2 a radial section through a gas turbine, FIGS. 3 and 4 schematically show the attachment according to the invention, FIG. 3 being an axial section and FIG. 4 a radial section through a turbine.

In the Figures, 1 designates a guide vane ring, 3 a sealing ring which is movably joined to the guide vane ring and cooperates with a sealing ring 5 on the rotor 7 of the turbine. The guide vane ring 1 may consist of individual blades 9 which are attached to a ring 11. In a multi-stage turbine, a plurality of guide vane rims 1 are arranged in a turbine housing 13, as shown in FIG. 5.

Figure 2:
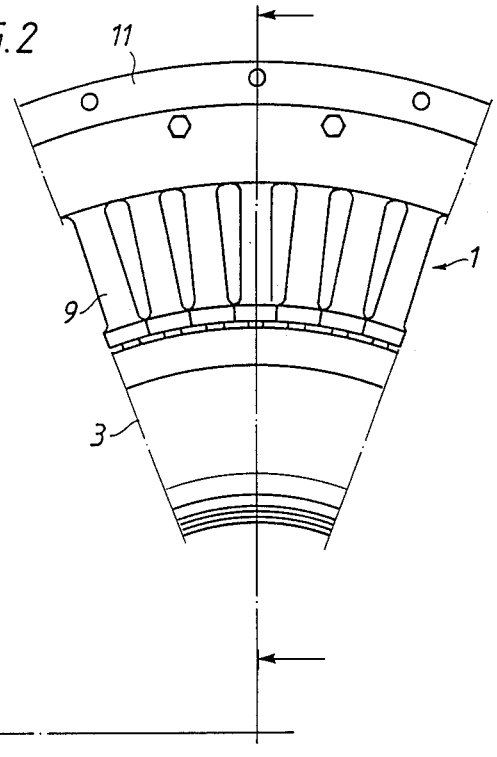

In a turbine the guide vane rim 1 will reach a higher temperature than the sealing ring 3. To enable the guide vane ring 1 and the sealing ring 3 to expand to differing degrees, they must be movably joined to each other. In known designs, as shown in FIGS. 1 and 2, the guide vane rim 1 or individual blades 9 therein is/are provided with radially oriented pins 15 projecting into bores 17 in the sealing ring 3. In this design, the friction and the weight of the sealing ring 3 may result in the sealing ring 3 not maintaining its concentric position relative to the centre line of the rotor 7. Eccentricity means uneven clearance. An increasing clearance on one part of the circumference and wear on another part of the circumference mean increased leakage of hot gas, involving harmful heating of the rotor 7.

Figure 3:
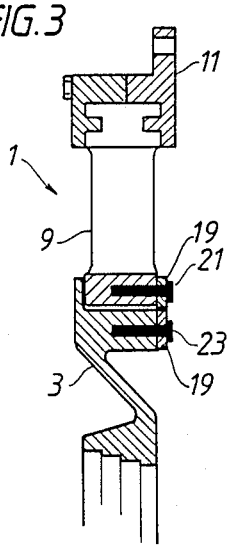
Figure 4:
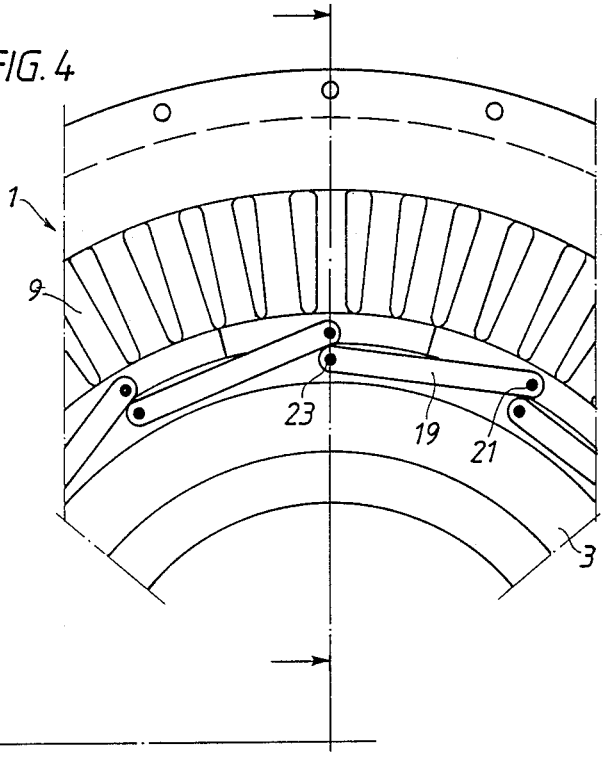

According to the invention, the sealing 3 is joined to the guide vane ring 1, as shown in FIGS. 3 and 4, by a number of links 19 which have an orientation deviating from a radial direction. Sutiably, they are substantially tangentially oriented. The links 19 are rotatably connected on the pins 21 and 23 in the guide vane ring 1 and the sealing ring 3, respectively.

Figure 5:
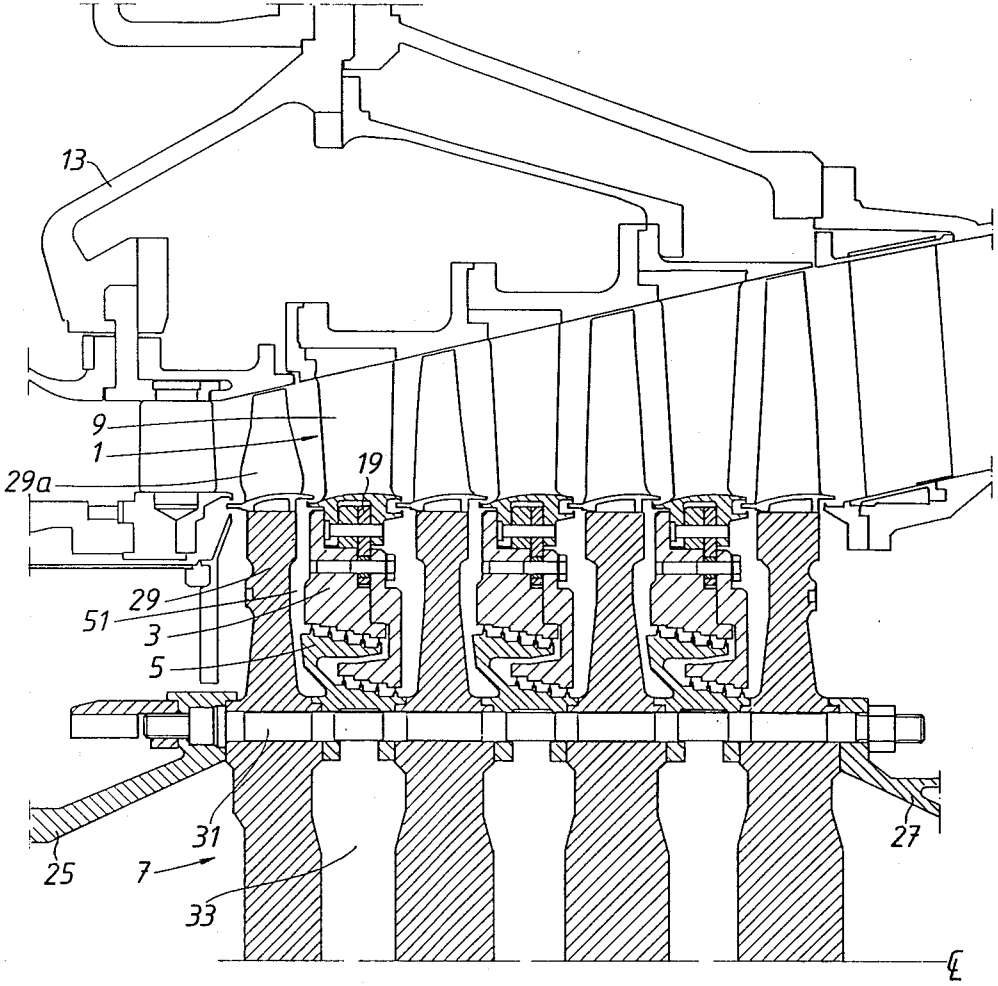
FIG. 5 shows a partial axial section through a multi-stage turbine to which the invention is applied.

The gas turbine shown in FIG. 5, in which the invention is applied, is a multi-stage turbine having three fixed guide vane rings 1 with sealing rings 3 in the turbine housing 13. The shown part of the rotor 7 consists of the tubular rotor parts 25 and 27, four rotor discs 29 with blades **29*a* and three rings 5 which are formed as sealing ring. These latter units are held together by a number of tie bolts 31. Through holes between the tie bolt holes the cooling air is supplied and distributed through holes in the spacers 33**.

Figures 6, 7, 8:
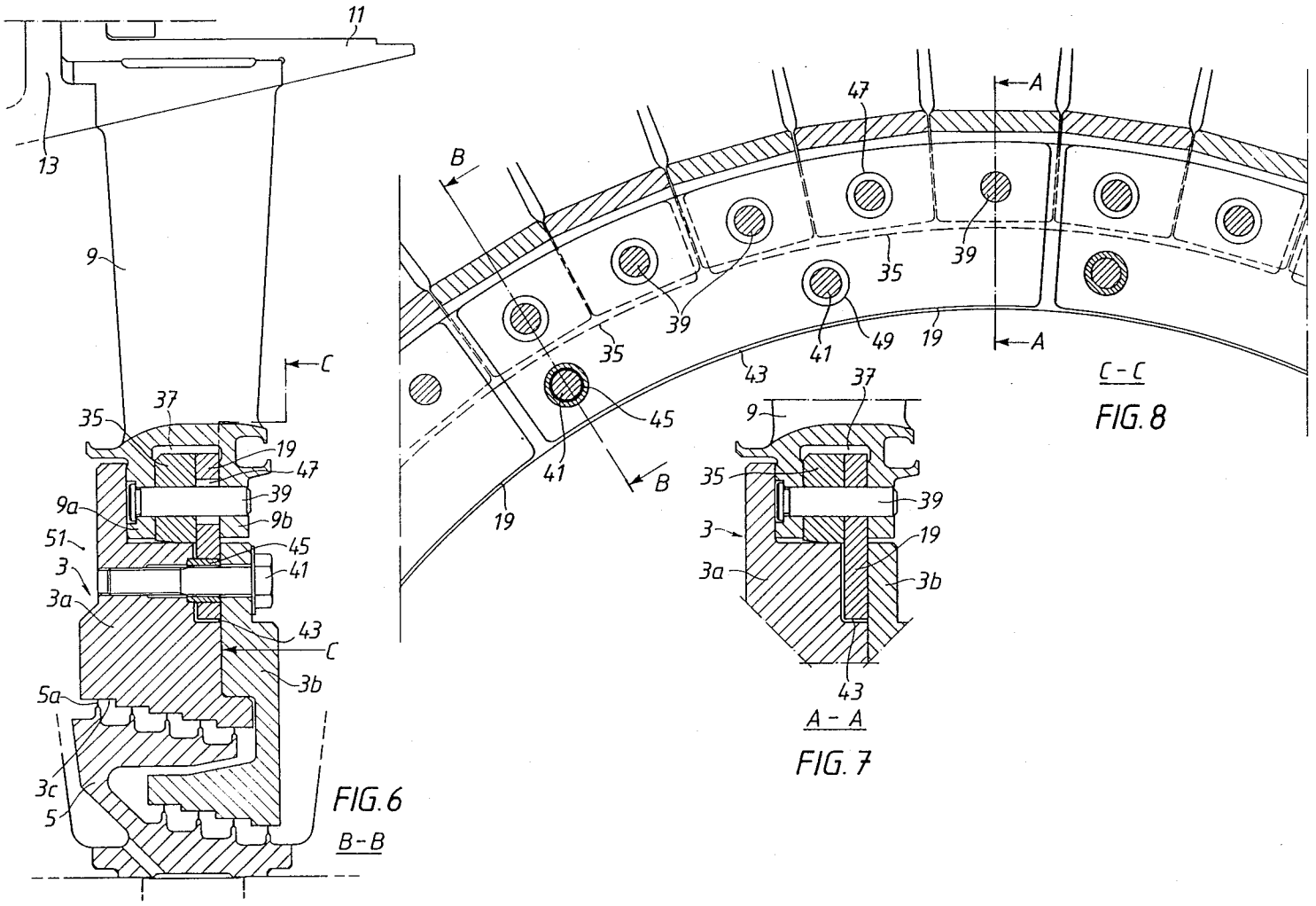
FIG. 6 shows on an enlarged scale an axial section through the turbine according to A—A in FIG. 8.
FIG. 7 shows a radial section accoridng to B—B in FIG. 6.
FIG. 8 shows an axial section according to C—C in FIG. 6.

As shown in FIGS. 6 to 8, five blades 9 in the vane rings 1 are joined at their inner shroud into a blade group with segments 35 in the gap 37 between the flanges **9*a* and 9*b* of the blades 9 and fitting bolts 39. The sealing ring 3 consists of two parts 3*a* and 3*b* retained by bolts 41. Between the parts 3*a* and 3*b*, a gap 43 is formed. The links 19, which connect the sealing ring 3 and the guide vane ring 1 and centers the sealing ring 3, are arranged in the gaps 37 and 43 in the guide vane 1 and the sealing ring 3**, respectively.

Section A—A shows how the links 19 are supported, at one end, on a fitting bolt 39. Section B—B shows the links 19 are supported, at the other end, on a bushing 45 between the parts **3*a* and 3*b* of the sealing ring 3. The links 19 have clearance holes 47 and 49 for the other bolts 39 and 41**, respectively.

When the guide vane ring 1 expands relative to the sealing ring 3, the links 19 will be turned around the pins 39 and the bushings 45 but still maintain the sealing ring 3 centered around the axis of rotation of the rotor 7. The good centering means that a small clearance can be reliably maintained between the flanges **5*a* of the rotor ring 5 and cooperating surfaces 3***c* in the sealing ring 3. The leakage flow through the labyrinth seal formed by the rings 3 and 5 becomes small. Only a small amount of cooling air from the space 33 in the rotor 7 need to be supplied, via the channel, to the space 51 between the turbine disc 29 and the sealing ring 3 to prevent hot gas from flowing into the space 51 and heating the rotor 7.

We claim:

1. A gas turbine housing (13), a rotor (7) in the turbine housing having at least one disc (29) with blades (29*a*), at least one guide vane ring (1) fixedly mounted in the turbine housing (13) and a sealing ring (3) movably connected to said guide vane ring (1), said sealing ring (3) cooperating with an annular sealing member (5) on the rotor (7), characterized in that the sealing ring (3) is connected to the guide vane ring (9) by means of a number of links (19), one end of which being rotatably attached to the guide vane ring (1), the other end being rotatably attached to the sealing ring (3), said links (19) having an orientation deviating from a radial direction.

2. A gas turbine according to claim 1, characterized in that the links (19) make an angle greater than 45° with a radial plane.

3. A gas turbine according to claim 1, characterized in that the links (19) are tangentially or almost tangentially oriented.

4. A gas turbine according to claim 1, characterized in that a number of guide vanes (9) are joined to each other in groups at the inner shroud of the vanes (9), and the sealing ring (3) is joined by means of the links (19) to at least three such groups of guide vanes (9).

* * * * *